United States Patent [19]

Famolare, Jr.

[11] 3,984,925

[45] Oct. 12, 1976

[54] HYBRID SOLE FOR SHOES

[75] Inventor: Joseph P. Famolare, Jr., Florence, Italy

[73] Assignee: Famolare, Inc., New York, N.Y.

[22] Filed: Dec. 19, 1974

[21] Appl. No.: 534,188

[52] U.S. Cl. ..... 36/31

[51] Int. Cl.[2] ..... A43B 13/14

[58] Field of Search ..... 36/24.5, 31, 34 R

[56] References Cited

UNITED STATES PATENTS

| | | | |
|---|---|---|---|
| 1,162,445 | 11/1915 | Bostock | 36/31 |
| 1,268,408 | 6/1918 | Tirrell | 36/31 |
| 1,289,711 | 12/1918 | Ettle et al. | 36/31 |
| 2,542,292 | 2/1951 | Seminara | 36/24.5 |
| 3,243,900 | 4/1966 | Ronci | 36/34 R |

*Primary Examiner*—Alfred R. Guest

*Attorney, Agent, or Firm*—Mandeville and Schweitzer

[57] ABSTRACT

A solid "wedge-type" sole for shoes is provided, having a sponge-like and relatively resilient material in the toe and arch regions of the sole in combination with a lift of a comparatively rigid material in the heel regions of the sole.

1 Claim, 2 Drawing Figures

HYBRID SOLE FOR SHOES

STATEMENT OF THE INVENTION

Generally, this invention relates to a specifically designed relatively solid wedge-type sole for shoes, to provide certain benefits for the wearer not otherwise available from conventional soles. More particularly, this invention relates to a wedge-shaped sole for shoes, in which all of the sole except for the heel area is comprised of a resilient material, such as crepe rubber, for example, in combination with a relatively hard material for the lift in the heel area of the sole. This sole, with its combined comparatively resilient and comparatively rigid, durable materials provides for the wearer, the relatively flexible giving action ordinarily associated with a resilient rubber sole, such as a crepe sole, while simultaneously providing the stability ordinarily associated with non-wedge-like soles, or wedge soles not comprised of a resilient material such as crepe rubber, for example.

BACKGROUND OF THE INVENTION

As is well known, crepe soled shoes have been used for a number of years in a variety of combinations, including solid wedge-type soles in which the entire sole is comprised of crepe rubber, or other elastomeric material, or conventional soles comprised entirely of crepe rubber in which a heel is cut out or formed out of a solid piece of crepe rubber. Such soles have found wide acceptance because crepe rubber provides a resilient, comfortable give-like feeling for the wearer and provides good "grip" or traction. However, such soles have proved unsatisfactory in certain applications, particularly after a period of use, because they do not provide the adequate stability required in shoes in order to avoid unnecessary strain to the ankle and upper portions of the foot of the wearer. That is, crepe rubber has a tendency to "give" too much, particularly on rough surfaces where the wearer might have a tendency to "turn" an ankle, or if the wearer is subject to certain physical disabilities, including distortions of the muscles and/or ligaments in the ankle, lower leg, or upper portion of the foot. This is particularly true after crepe rubber soles have been used for awhile, in that the material tends to break down or wear on the inner or outer edges of the sole, causing the wearer to turn an ankle much more readily on an uneven surface. Because of this, although resilient materials such as crepe rubber have certain advantages in providing enhanced comfort for the wearer, in many instances, certain people avoid utilizing shoes with such crepe rubber because of the tendency of the rubber to cause undue flexing of the ankle laterally during a walking action.

SUMMARY OF THE INVENTION

With this invention, by contrast, a new and improved sole for shoes is provided, which enhances the comfort of the wearer and the stability thereof, not previously known in shoes utilizing a resilient material such as a crepe rubber. This is achieved by providing a combination sole in which the heel area thereof is comprised of a different material from the comparatively resilient material of the rest of the sole. That is, the heel area is comprised of a lift of a relatively hard material, such as nylon, for example, while the rest of the sole is comprised of the resilient, flexible material, such as crepe rubber or other resilient material or synthetic elastomers. With this combination, the hard heel area gives the necessary stability and prevents lateral flexure of the wearer's ankle, while the rest of the sole comprised of the comparatively resilient material gives the comfort ordinarily associated with crepe rubber. Preferably, the lift will include an integral forwardly facing lip extending transversely across the bottom front face thereof, to provide a rigid, interlocking connection between the resilient portion of the sole, and the hard lift of the sole.

Before describing this invention further, it should be noted that the flexible portion of the sole herein may be manufactured by molding from natural or synthetic elastomers, various resins, including a variety of foamed resin materials. Preferably, it will be crepe rubber. The heel portion or lift of the sole of the invention may be comprised of various resins, including thermoplastics and may be molded from these thermoplastics, or it may be comprised of natural leathers. Preferably, it will be nylon. The soles may be combined with a conventional upper of a flexible material, including leathers, or synthetic materials, canvas and other fabrics, to form a unique and improved shoe. Moreover, the upper may be a conventional low heeled or "flat" shoe, or a high heeled shoe and may be of a scuff-like design with an open heel, or it may be straps providing a sandal-like configuration.

With the foregoing and additional objects in view, this invention will now be described in more detail, and other objects and advantages hereof will be apparent from the following description, the accompanying drawings and the appended claims.

As purely illustrative of an arrangement of the sole of this invention, the accompanying drawings illustrate a "wedge" high heeled shoe with a sandal-like upper.

DESCRIPTION OF THE PREFERRED EMBODIMENT

Figure 1:
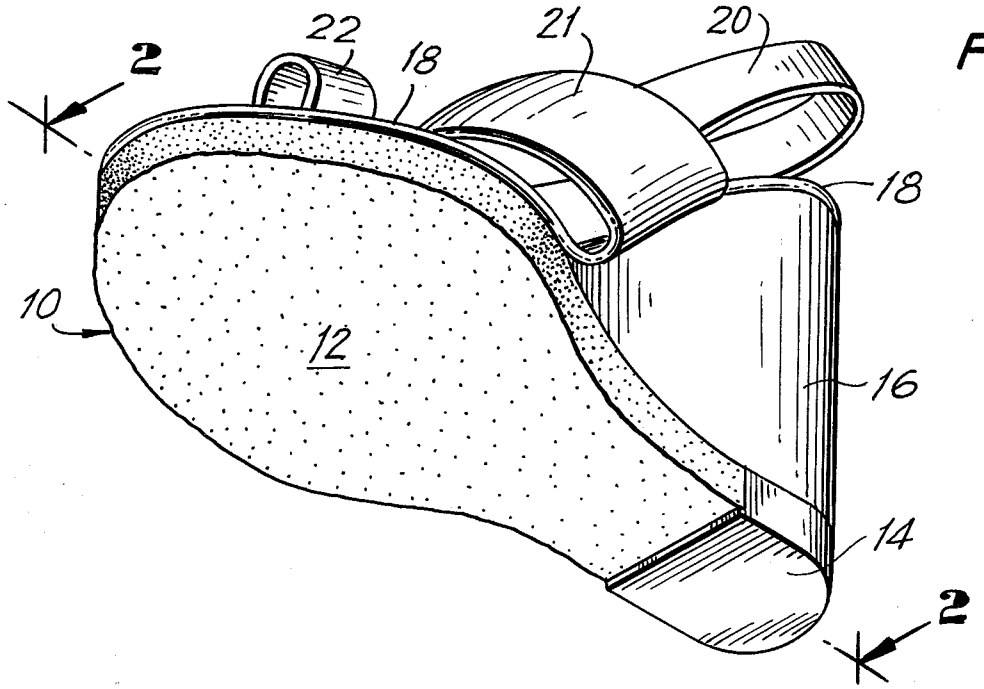
FIG. 1 is a perspective view of a "wedge" high heeled shoe, incorporating the sole of the invention.
Figure 2:
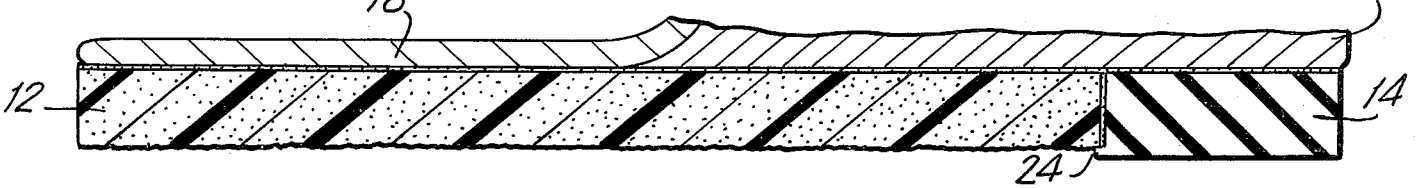
FIG. 2 is a cross section taken along lines 2—2 of FIG. 1.

Referring to the drawings in which like reference characters refer to like parts throughout the several views thereof, FIG. 1 shows a "wedge" high heeled shoe, generally designated 10, having a sole comprised of a comparatively resilient material 12, in combination with a lift 14 of a relatively rigid material. While this combined sole may be utilized for a flat shoe, it is shown in combination with a high heeled sandal, including a solid wedge 16 for providing the high heeled configuration, and an insole 18 disposed on the upper surface thereof. Connected to this structure is an upper of a sandal design, including a heel strap 20, an arch strap 21 and a toe thong 22. As can be seen in FIG. 2, the sole presents a flat bottom surface and is solid. Nevertheless, it combines the rigid lift 14 with the resilient material 12 of the rest of the sole, which may be, for example, crepe rubber. Preferably, lift 14 will have a forwardly protruding lip 24 for enhancing the connection between the two portions 12, 14 of the sole.

Thus, as will be apparent from the foregoing, a wedge-type sole is provided which includes in combination, the comfortable, resilient "give" of a crepe sole, while presenting in the heel portion thereof, a comparatively rigid material for enhancing the stability of the wearer. Thus, when wearers are confronted with an uneven surface, they are much less likely to turn the ankle or to subject the ankle or upper foot area to stress-type lateral flexures causing injury and/or damage to those areas. Because of this, the comfort ordinarily associated with "crepe" soles is available for those people who suffer from "weak" ankles, or in some other way suffer some physical disablement which would ordinarily require that they avoid the use of crepe soles.

While the particular arrangement of sole described herein is one embodiment of this invention, this invention is not limited to that particular arrangement, and as will be appreciated and understood by those skilled in the art, changes may be made therein without departing from the scope of the invention, which is defined in the appended claims. For example, the specific geometry of the sole may be modified or somewhat altered in terms of proportions, while maintaining the beneficial properties and appearance of the illustrated sole.

I claim:

1. A hybrid sole for shoes comprising a. a solid first portion forming the toe and arch areas of said sole;

b. said solid first portion being comprised of comparatively soft, elastomeric, crepe rubber-like resilient material; and c. a second lift portion forming the heel area of said sole;

d. said solid second portion being of comparatively hard, rigid, non-elastomeric, nylon-like material;

e. said second portion including a transverse lip integral therewith and disposed on the lower face thereof contiguous with said first portion; and f. said lip bridging the seam formed between said first and second portions.

* * * * *